US006769742B2

(12) United States Patent
Siepenkort

(10) Patent No.: US 6,769,742 B2
(45) Date of Patent: Aug. 3, 2004

(54) CLAMPED CHAIN COVER FOR LONGWALL PLOUGH GUIDE

(75) Inventor: Gerhard Siepenkort, Lunen (DE)

(73) Assignee: DBT GmbH, Lunen (DE)

( * ) Notice: Subject to any disclaimer, the term of this patent is extended or adjusted under 35 U.S.C. 154(b) by 35 days.

(21) Appl. No.: 10/086,323

(22) Filed: Mar. 1, 2002

(65) Prior Publication Data

US 2002/0121804 A1 Sep. 5, 2002

(30) Foreign Application Priority Data

Mar. 2, 2001 (DE) ..... 201 03 704 U

(51) Int. Cl.[7] ..... E21C 35/12
(52) U.S. Cl. ..... 299/34.1; 299/47
(58) Field of Search ..... 299/47, 34.01, 299/34.1, 34.07; 403/315, 316, 317; 292/256.71, 256.73, 256.75; 411/169, 173, 84.05

(56) References Cited

U.S. PATENT DOCUMENTS 2,762,473 A * 9/1956 Swerdlow ..... 292/256.71
4,391,471 A * 7/1983 Hauschopp et al. ..... 299/34.1
5,167,438 A * 12/1992 Fiesel et al. ..... 299/34.1

* cited by examiner

*Primary Examiner*—John Kreck
(74) *Attorney, Agent, or Firm*—Cook, Alex, McFarron, Manzo, Cummings & Mehler, Ltd.

(57) ABSTRACT

A plough guide for underground mining ploughs, with angle plates (5), whose extended arm (8) is fastened on the working face side to the conveyor pan (3) of a chain scraper conveyor and whose base arm (7) towards the face, supported on the ground (6), forms a sliding track for the plough, with upper and lower chain channel slides (11, 12) for the plough chains separated by distance pieces (9) fastened preferably at a distance from each other on extended arms of the angle plates, with a cover (15) closing the chain channels (12, 11) to the working face side and which can be pivoted towards the face, having at least one abutment part (21), which can be fixed on the plough guide and released, and with a guide rail (18) arranged on the plough guide at a distance from the sliding plough track. The abutment part (21) of the cover (15) is clamped between the angle plate (5) and a securing part (30) at a distance from the cover (15) screwed onto the angle plate (5).

18 Claims, 1 Drawing Sheet

CLAMPED CHAIN COVER FOR LONGWALL PLOUGH GUIDE

BACKGROUND AND SUMMARY OF THE INVENTION

The present invention relates to a plough guide for underground mining ploughs, with angle plates, whose extended arm is fastened on the working face side to a conveyor pan of a chain scraper conveyor and whose base arm towards the face, supported on the ground, forms a sliding track for the plough, with upper and lower chain channel slides for the plough chains separated by distance pieces fastened preferably at a distance from each other on extended arms of the angle plates, with a cover closing the chain channels to the working face side and which can be pivoted towards the face, having at least one abutment part, which can be fixed on the plough guide and released, and with a guide rail arranged on the plough guide at a distance from the sliding plough track.

Plough guides are known to comprise individual guide troughs which, on the working face side, are built onto the conveyor pans of the chain scraper conveyor forming the line of pans and in mining operation form a positive guide for the plough body moving along the working face. The drive to the plough body is effected by means of a circulating plough chain guided in chain channels in the plough guide, whereby the traction strand is formed as a rule by the lower chain channel, in which an arm or similar of the plough body can engage from outside. Owing to the plough chain being moved along the whole face all the plough guides are subject to heavy vibration independently of the instantaneous position of the plough. The plough guides are subject to extraordinarily high demands, especially high deforming forces, a high rate of wear and the vibrations previously mentioned. Extreme loading always arises when the plough body passes through the individual plough guides and its whole weight is supported on the upper guide formed from the guide rail, on the lower guide formed by the lower chain channel and the guide beam and on the slide track.

Previously proposed plough guides are known in different forms of construction, for instance from DE 37 37 525 A1. In this previously proposed plough guide the guide rail forming the upper guide is welded onto the head of a cover formed by a covering cap and a foot region of the cover forms the pivot bearing. In the closed position of the cover a foot section of the guide rail lies on welding pieces, which are welded onto the extended arm of the angle plate. Since the cover cap must be able to bear the weight of the mining plough, the foot section of the guide rail is fastened by a screwed connection to the extended arm of the angle plate or the welded pieces welded onto it. The screwed connection comprises strong centring screws for this, which sit in matching clearance holes in the foot section, with large surface centring pieces. Collar nuts are screwed onto the threaded shafts of the centring screws, with which the abutment faces on the mating surfaces formed from the extended arms of the angle plate are maintained relatively large. By the matching of the close toleranced clearance holes engaged through by the centring screws on the one hand a precise height centring of the guide rail and at the same time a large surface support for it can be achieved, so that a reliable acceptance of the high vertical forces acting on the guide rail as the plough passes over is provided.

In spite of the centring screws used in the previously proposed plough guide, having threaded shafts of reduced diameter and large area collar nuts, the screwed connections securing the closed position of the cover cap can become loose, which can be traced back to the high vibrations and vertical forces, which in the operation of the plough body and the plough traction chain are exerted on the foot region of the covers formed as a pivoting joint.

It is an aim of the present invention therefore to produce plough guide slides, in which these disadvantages are avoided, wherein especially the loosening of the screwed connection securing the closed position is counteracted, so that overall a reliable formation of the plough guide slide is achieved.

Accordingly the present invention is directed to a plough guide as described in the opening paragraph of the present specification, in which the abutment part of the cover is clamped in between the angle plate and a securing part at a distance from the cover screwed to the angle plate.

Owing to the movement according to the invention of the fastening axis of the screwed connection out of the region of the cover cap and the abutment parts the formerly present rigid screw connection between the cover cap and the plough guide is replaced by a clamp fixing loaded only indirectly by the forces acting on the cover. Even unfavourable horizontal or bending forces acting on the foot area of the cover during the sliding along of the plough do not affect the screw fastening of the securing part, since the cover cap guided in principle loosely in the head region can perform equalising movements.

Preferably the securing part has a clamping arm engaging over the abutment part. Advantageously the securing part is configured with two arms and has a strong cross arm provided with through holes for fastening screws, which preferably is fastened to the plough guide above the cover by means of the fastening screws, whereby the clamping arm directed towards the ground engages over the abutment part. With this configuration the securing part can be reliably fixed by means of screw fastenings tightened with high torque to the plough guide, whilst the clamping arm prevents the opening of the cover by a positive engagement. At the same time with this arrangement for avoidance of high levered forces a favourable separation between the fastening axis of the screw fastening of the securing part and the resultant forces transmitted by the abutment part acting on the clamping arm can be obtained.

In order to counteract the vibrations introduced in the plough guide, in a preferred embodiment one or more damping element(s) is/are arranged between the abutment part and the arm of the angle plate and/or between the abutment part and the securing part. Advantageously the damping element comprises a preferably elastic or plastic deformable bolt(s) or similar which can be inserted in a through hole in the abutment part, whose length is preferably greater than the depth of the abutment part, so that the region of the damping element extended above the abutment part is deformed during the assembly and fastening of the securing part and acts to damp the vibrations between the abutting adjacent metal surfaces. An expedient deformation can especially be achieved if the bolt is formed with a collar or head section, whose outer diameter is greater than the internal diameter of the through hole. Alternatively the damping element comprises plates, knobs, or rails of elastic or plastic deformable material, attached to the abutting surfaces of the abutment part, of the clamping arm of the securing part or the extended arm, especially screwed on, fitted into or glued on, which again damp the vibrations between the individual metal surfaces lying on each other. Both the named embodiments with a damping element are advantageous, if due to the dimensions of the cross arm in the assembled condition a gap, filled out by the deformed damping element, preferably with a gap width of some 1 to 2 mm is formed between the clamping arm and the abutment part and/or between the abutment part and the extended arm. The elastic or plastic damping element can spread out under compression, so as to prevent or damp vibrations.

In a further advantageous embodiment of the invention the guide rail forming the upper guide for the plough is combined with the extended arm of the angle plate or is a component of this arm and the abutment part of the cover and the securing part are clamped or screwed onto a foot section of the guide rail or to the extended arm. By this embodiment the guiding forces exerted on the upper guide can be supported immediately via the angle plate so that—in contrast to the previously known embodiment—the cover is not exposed to the high plough forces. The foot section of the guide rail or with integral conformation of the guide rail and the angle plate their horizontal arm hereby offers a sufficient designed anchoring cross section for the screwed connection of the securing parts.

Advantageously the abutment part comprises abutment rails formed on the head of the cover or welded on, whereby the cover is secured to the extended arm by means of several, especially by means of two securing parts. Preferably the cover is formed from a cover cap, which can be mounted to fold at its lower, ground facing end in hinge joints, which are preferably mounted at the height of the slide distance pieces. In a preferred embodiment the hinge joints only require here to accept the force of the weight of the cover cap enclosing the upper chain channel.

Advantageously the abutment part with the exception of the clamping lies essentially loosely on the arm of the angle plate.

BRIEF DESCRIPTION OF THE DRAWINGS

A plough guide made in accordance with the present invention will now be described hereinbelow with reference to the accompanying drawing, in which.

DESCRIPTION OF THE PREFERRED EMBODIMENTS

Figure 1:
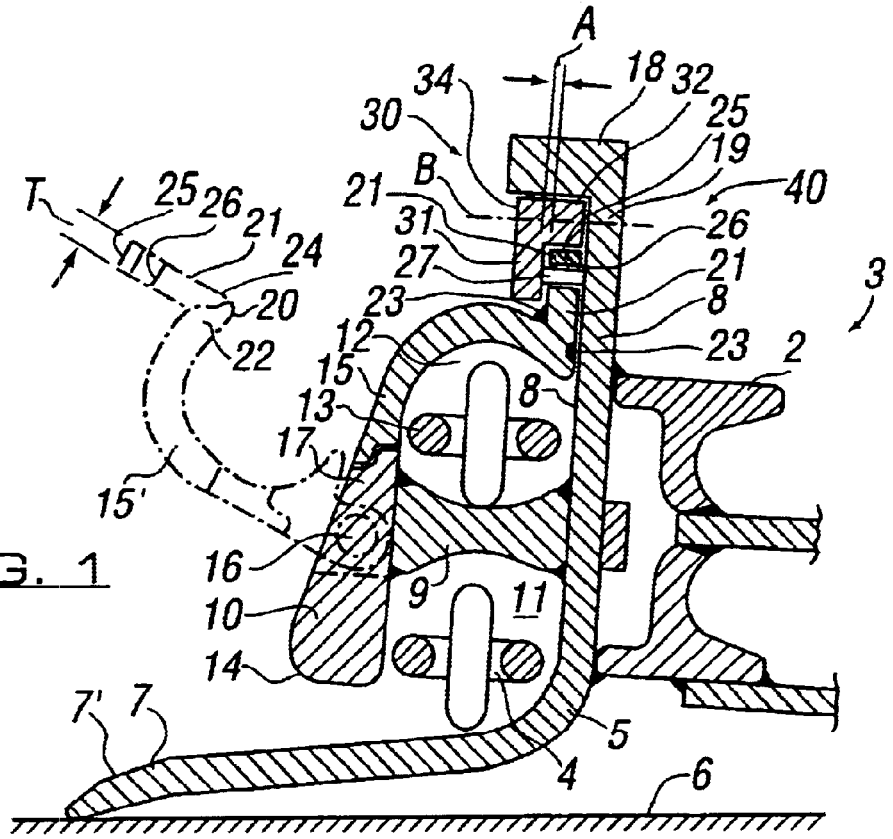
FIG. 1 shows a cross sectional view of a plough guide according to the present invention welded onto a chain scraper conveyor on the working face side.

A plough guide trough is shown in FIG. 1, referenced overall with the reference number 1 is built onto the side profiles 2 of a line of pans 3 of a chain scraper conveyor, not shown further. A multiplicity of conveyor pans 3, hinge linked together with limited movement and with tensile strength and plough guide troughs 1 form together the plough guide deployed at the face, along which travels a plough joined via a guide arm to the traction strand 4 of the plough chain.

Each guide trough 1 of the plough guide comprises an angle plate 5, which has a ground arm 7 slightly inclined to the ground 6 and supported on it and an essentially vertical, i.e. parallel to the working face, extended arm 8 and extends somewhat over the length of the guide trough 1 and the conveyor pan 3 welded to the arm 8. The upper side 7' of the ground arm 7 forms a lower sliding track for the plough body, not shown and, together with the strong guide beam 10 and the lower chain channel 11 forms the lower guide for the plough. The guide beam 10, which extends like the angle plate 5 and the side profile 2 over the entire width of a conveyor pan, is joined to the extended arm 8 of the angle plate 3 via several sliding distance pieces 9 arranged at a distance from each other. The connection shown in the embodiment depicted as a welded connection between the guide beam 10, the sliding distance pieces 9 and the arm 8 can also be formed as a screwed connection.

The sliding distance pieces 9 separate the lower guide channel 11, in which the traction strand 4 of the plough chain runs, from the upper chain channel 12, in which the return strand 13 of the plough chain is guided. The guide beam 10 extends somewhat up to the upper side of the sliding distance pieces 9 and its broad, rounded lower guide surface 14 is separated from the base plate 7, so that the arm of the plough body can engage into the traction strand 4 of the plough chain. The guide beam 10 supports the plough at the same time.

The upper chain channel 12 of each plough guide trough 1 has a cover cap, preferably bowed, as an opening and closing cover 15, which on its two lower side ends is mounted on hinge joints 16, shown schematically in FIG. 1, somewhat at the height of the sliding distance pieces so that it can pivot on extended head pieces 17 of the guide beam 10. In FIG. 1 the closed position of the cover 15 is shown by solid lines and the open position of the cover 15' by chain dotted lines.

In the embodiment shown the upper end of the extended arm 8 of the angle plate 5 ends in a strongly constructed guide beam 18, which forms the upper guide for the plough. The guide beam 18 has an essentially rectangular cross section and is engaged at least partly around by guide shoes or similar of the plough. Deviating from the embodiment shown, the foot section 19 including the transitional section between the extended arm 8 and the guide beam 18 can be made broader in cross section than the arm 8 and/or the foot section 19 and the guide beam 18 can be formed from a separate component, which for instance is joined to the extended arm 8 by a welded connection.

The present invention relates especially to the securing of the cover 15 in the closed position shown by solid lines. For this purpose the cover 15 has in its upper head section 20 preferably two rectangular rail nieces extending out as abutment parts 21. The abutment parts 21 have essentially the same strong thickness as the wall of the cover 15 and/or the arms 7, 8 of the angle plate 5. The abutment parts 21 are preferably welded onto the head section 20 of the cover 15 and have, as FIG. 2 especially shows, an essentially rectangular cross section, whereby the under sides 22 of the abutment parts 21 are locked against the cover cap 15 by welded joints 23. The abutment parts 21, whose conveyor side rear sides 24 lie loosely against the working face side front surface 8' of the arm 8, are reliably retained in the closed position by the securing parts, referenced overall as 30.

Figure 2:
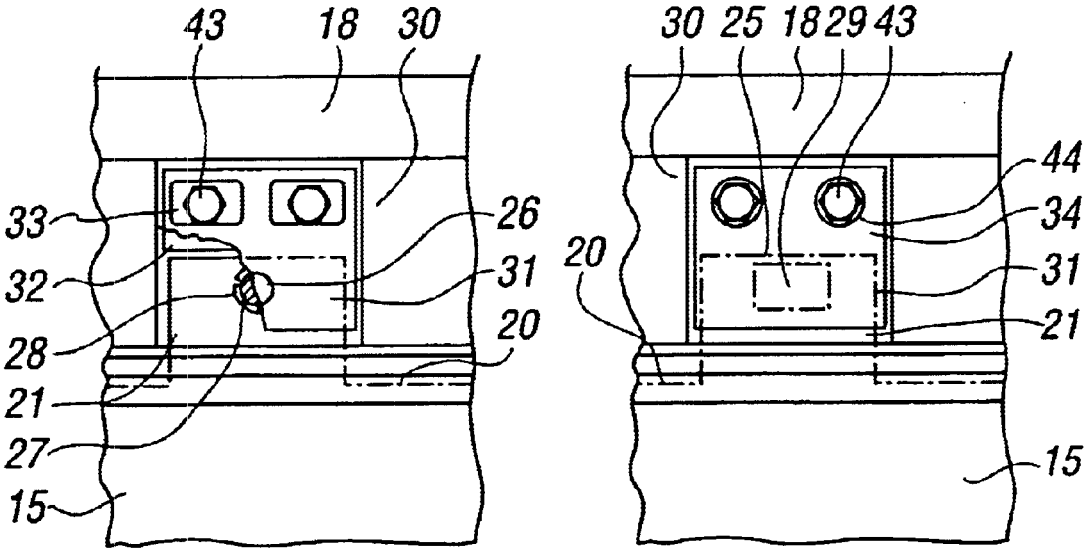
FIG. 2 shows schematic side sectional views of the fastening of the cover caps in the closed position by means of the securing parts according to the present invention.

These securing parts 30 provided according to the invention comprise two-armed, strong, preferably L-shaped angle iron, whereby the longer arm 31 forms a clamping arm and the shorter, thicker cross arm 32 the abutment arm onto the foot section 19 of the guide rail 18. The cross arm 32 has through holes, not shown, which are engaged through by fastening screws referenced overall as 40; the fastening screws are indicated schematically in FIG. 1 by means of the fastening axis B and include for instance collar nuts, with which the securing part 30 is fixed without play, in pockets or similar on the conveyor side of the extended arm 8 of the plough guide. The fastening axis B of the fastening screws 40 lies at a distance from the upper head side front end 25 of the abutment part 21, but outside the cover 15. The threaded bolts of the fastening screws 40 have bolt heads 43 (FIG. 2), which for instance as shown on the left hand side in FIG. 2, are formed as hexagonal nuts and can sit so that they cannot turn in cut-outs 33 which are formed in working face front side 34 of the securing part 30; alternatively they can also, as is shown to the right in FIG. 2, be supported with the interposition of washers 44 with a large surface on the front surface 34 of the securing part 30. The construction shown on the left in FIG. 2 with positively engaging cut-outs 33 for the bolt heads 43 offers the advantage that they do not have to be held fast when tightening the fastening screws 40.

As FIG. 1 and FIG. 2 show, the clamping arm 31 extends vertically starting from the cross arm 32 towards the ground 6 and hereby engages, in the closed position of the cover 15, over the abutment parts 21. These again have centrally or close to their head side front ends 25 an insertion hole 26 for the acceptance of one or more damping elements of elastically deformable rubber or plastic deformable plastics material. In the embodiment according to FIG. 1 and the left-hand side of FIG. 2 a plastics material bolt 27 is inserted in the insertion hole 26, which extends out to one or both of the long sides of the abutment rail 21. This section of the plastics material bolt 27 standing proud over the long sides is deformed during the fastening of the securing element 30 by tightening the fastening bolts 40, so that the gap A, by which the clamping rail 31 is separated from abutment rail 21 lying loosely on the front face 8' of the plough guide 1 is filled by the deformed material sections. The width of the gap A, which is determined by the dimensions of the cross arm 32 in relation to the depth T of the abutment part 21, is hereby partly filled so as to damp the vibrations, which otherwise could lead to loosening of the fastening of the cover 15. The region 28 of the plastics material bolt 27 cramped and deformed during clamping and squashing is indicated schematically in the left-hand half of FIG. 2.

The right-hand half of FIG. 2 shows an alternative configuration for a damping element filling out the gap A between the abutment part 21 and the clamping arm 31 in the form of a rubber and plastics material plate attached to the inner side of the clamping arm 31. Alternatively or additionally a corresponding damping element could be attached to the conveyor side rear side 24 of the abutment part 21, so that all the metallic abutment faces between the plough guide 1, the abutment part 21, the cover cap 15 and the securing part 30 are damped against vibration by means of damping elements.

FIG. 2 is intended to make clear that each cover cap 15 of a guide trough 1 can be provided with exactly two short, abutment parts 21 extending above the head section 20 of the cover 15, which are clamped onto the extended arm 8 of the angle plate 3 by means of two securing parts 30.

A number of modifications will be readily occur to a man skilled in the art a number of modifications resulting from the foregoing description, which fall within the scope of the claims. Thus instead of one plastics material bolt several plastics material bolts, knobs etc. can be fastened to the abutment parts 21. The fastening of the securing part 30 with the fastening screws 40 is preferably made above the abutment parts 21 to the extended arms 8 or to the foot section 19 of the guide rail 18. Alternatively U-shaped securing plates or similar could be used, which are fastened on both sides of the abutment parts 21, consequently to their sides, which are fastened to the extended arms 8.

What is claimed is:

1. A plough guide for underground mining ploughs, with angle plates, whose extended arm is fastened on th working face side to a conveyor pan of a chain scraper conveyor and whose base arm toward the face, supported on the ground, forms a sliding track for the plough, with upper and lower chain channel slides for the plough chains separated by distance pieces fastened on extended arms of the angle plates, with a cover closing the chain channels to the working face side an which can be pivoted towards the face, having at least one abutment part, which can be fixed on the plough guide and released, and with a guide rail arranged on the plough guide at a distance from the sliding plough track, in which the abutment part of the cover is clamped between the angle plate and a securing part at a distance from the cover screwed to the angle plate.

2. A plough guide according to claim 1, in which the distance pieces are fastened at a distance from each other on the extended arms of the angle plates.

3. A plough guide according to claim 1, in which the securing part has a clamping arm engaging over the abutment part.

4. A plough guide according to claim 1, in which the securing part is configured with two arms and has a strong cross arm provided with through holes for fastening screws, which is fastened to the plough guide above the cover by means of the fastening screws, whereby the clamping arm directed towards the ground engages over the abutment part.

5. A plough guide according to claim 1, in which one or more damping element(s) is/are arranged between the abutment part and the arm of the angle plate and/or between the abutment part and the securing part.

6. A plough guide according to claim 5, in which the damping element comprises a deformable bolt which can be inserted in an through hole in the abutment part.

7. A plough guide according to claim 6, in which the deformable bolt comprises an elastic or plastic material.

8. A plough guide according to claim 6, in which the length of the deformable bolt is greater than the depth of the abutment part.

9. A plough guide according to claim 6, in which the bolt is formed with a collar or head section, whose outer diameter is greater than the internal diameter of the through hole.

10. A plough guide according to claim 5, in which the damping element comprises plates, knobs, or rails of plastic or plastic deformable material, attached to the abutting surfaces of the abutment part, of the clamping arm of the securing part or the extended arm, which may be screwed on or glued on.

11. A plough guide according claim 1, in which due to the dimensions of the cross arm in the assembled condition a gap, filled out by a deformed damping element, is formed between the clamping arm a the abutment part and/or between the abutment part and the extended arm.

12. A plough guide according to claim 11, in which the gap width is of some 1 to 2 mm.

13. A plough guide according to claim 1, in which the guide rail forming the upper guide for the plough is combined with the extended arm of the angle plate or is a component of this arm and the abutment part of the cover and the securing part are clamped or screwed onto a foot section of the guide rail or to the extended arm.

14. A plough guide according to claim 1, in which the abutment part comprises abutment rails formed on the head of the cover or welded on, whereby the cover is secured to the extended arm by means of several parts.

15. A plough guide according to claim 1, in which the cover is secured to the extended arm by means of two securing parts.

16. A plough guide according to claim 1, in which the cover is formed from a cover cap, which is mounted to fold at its lower, ground facing end in hinge joints.

17. A plough guide according to claim 16, in which the hinge joints are mounted at the height of the slide distance pieces.

18. A plough guide according to claim 1, in which the abutment part with the exception of the clamping lies essentially loosely on the arm of the angle plate.

* * * * *